US009868195B2

(12) United States Patent
Chang

(10) Patent No.: US 9,868,195 B2
(45) Date of Patent: Jan. 16, 2018

(54) HAND TOOL ASSEMBLY

(71) Applicant: Man-Chi Chang, Taichung (TW)

(72) Inventor: Man-Chi Chang, Taichung (TW)

( * ) Notice: Subject to any disclaimer, the term of this patent is extended or adjusted under 35 U.S.C. 154(b) by 310 days.

(21) Appl. No.: 14/886,095

(22) Filed: Oct. 19, 2015

(65) Prior Publication Data

US 2017/0106508 A1 Apr. 20, 2017

(51) Int. Cl.

| | |
|---|---|
| ***B25B 23/00*** | (2006.01) |
| ***B25B 13/46*** | (2006.01) |
| ***B25B 15/04*** | (2006.01) |
| ***B25G 1/00*** | (2006.01) |

(52) U.S. Cl.

CPC ..... *B25B 23/0021* (2013.01); *B25B 13/463* (2013.01); *B25B 15/04* (2013.01); *B25G 1/005* (2013.01)

(58) Field of Classification Search

CPC ... B25B 23/0021; B25B 13/463; B25B 15/04; B25G 1/005

See application file for complete search history.

(56) References Cited

U.S. PATENT DOCUMENTS 1,578,065 A * 3/1926 Bemus et al. ..... B25B 13/463 81/177.2
3,575,069 A * 4/1971 White ..... B25B 13/463 81/177.2
7,150,208 B2 * 12/2006 Debley ..... B25B 13/461 81/177.2
7,370,560 B2 * 5/2008 Andersin ..... A61B 17/862 81/58.5
7,387,053 B2 * 6/2008 Lee ..... B25B 23/0021 81/177.1
7,600,451 B2 * 10/2009 Lechot ..... A61B 17/1624 81/60
8,869,659 B2 * 10/2014 Chang ..... B25B 13/00 81/177.1
8,887,599 B2 * 11/2014 Evans ..... B25B 13/04 81/177.2
2006/0011019 A1 * 1/2006 Chen ..... B25B 13/463 81/63.1
2009/0145268 A1 * 6/2009 Laurie ..... B25B 13/463 81/60
2016/0059394 A1 * 3/2016 Hu ..... B25B 23/0035 81/60

* cited by examiner

*Primary Examiner* — David B Thomas

(57) ABSTRACT

A hand tool assembly includes a cylindrical first body having multiple first grooves. A driving head is connected to one end of the first body and has a ratchet wheel which is controlled by a ratchet mechanism in the driving head. The first body extends through the ratchet wheel. A handle unit is movably mounted to the first body and the handle unit is selectively positioned at one of the first grooves. The second body has two different connection portions on two ends thereof, and the second body can be replaced by other handle tools.

10 Claims, 12 Drawing Sheets

HAND TOOL ASSEMBLY

BACKGROUND OF THE INVENTION

1. Fields of the Invention

The present invention relates to a hand tool, and more particularly, to a hand tool assembly comprising a first body, a second body, a driving head and a handle unit to perform different functions.

2. Descriptions of Related Art

The conventional hand tool assembly is disclosed in U.S. Pat. No. 8,869,659 and comprises a T-bar and a handle unit which is connected to the T-bar. The T-bar has multiple grooves defined in the outer periphery thereof, and the handle unit is movably along the T-bar and positioned at the grooves. However, the T-bar cannot be connected with multiple different hand tools quickly, and the shape of the T-bar is fixed and occupies too much space which is not convenient for storage, packing and transportation. The T-bar has two fixed ends which can only be connected with limited types of hand tools.

The present invention intends to provide a hand tool assembly to eliminate the shortcomings mentioned above.

SUMMARY OF THE INVENTION

The present invention relates to a hand tool assembly and comprises a cylindrical first body having a first connection portion on the first end thereof, and multiple first grooves are defined in the outer periphery of the first body. A driving head is connected to the second end of the first body and has a non-circular mounting hole. An engaging slot is defined in the inner periphery of the mounting hole. A positioning member is engaged with the engaging slot. A cylindrical second body extends through the mounting hole. A sixth connection portion and a seventh connection portion are respectively formed on two ends of the second body. A fifth connection portion is formed on the outer periphery of the second body and located at the middle portion of the second body. The fifth connection portion is engaged with the mounting hole. The fifth connection portion has a second groove. The positioning member is engaged with the engaging slot and the second groove. A handle unit has a handle, a control member and at least one engaging member. The first body extends through the handle. When the handle moves to a first position relative to the first body, the control member moves to a second position relative to the handle. The control member pushes the at least one engaging member to be engaged with one of the first grooves to position the handle to the first body.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
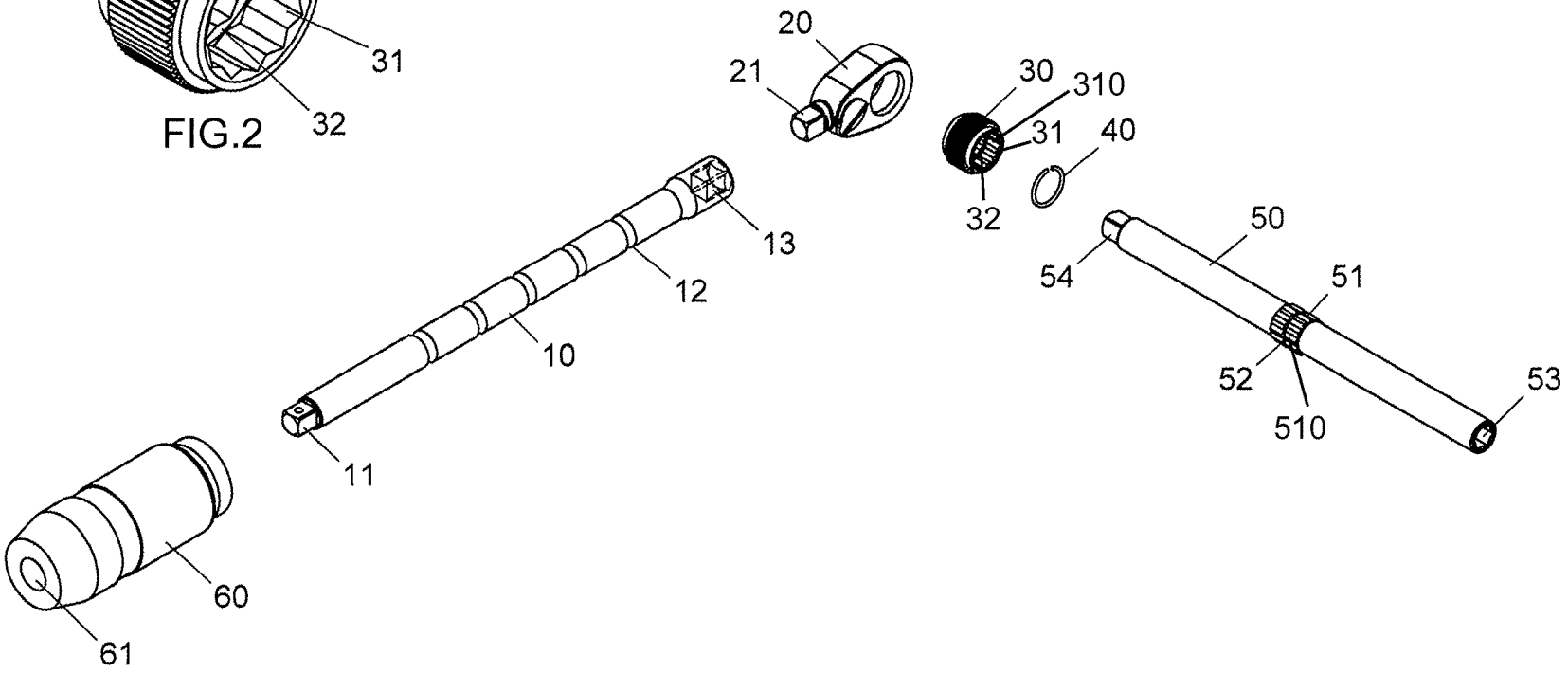
FIG. 1 is an exploded view of the hand tool assembly of the present invention.
Figure 2:
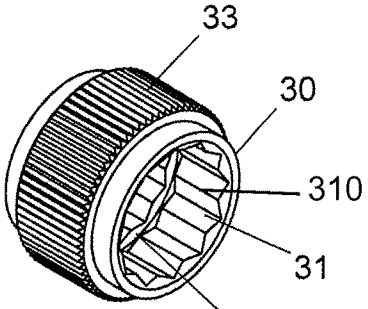
FIG. 2 shows the ratchet wheel of the hand tool assembly of the present invention.
Figure 3:
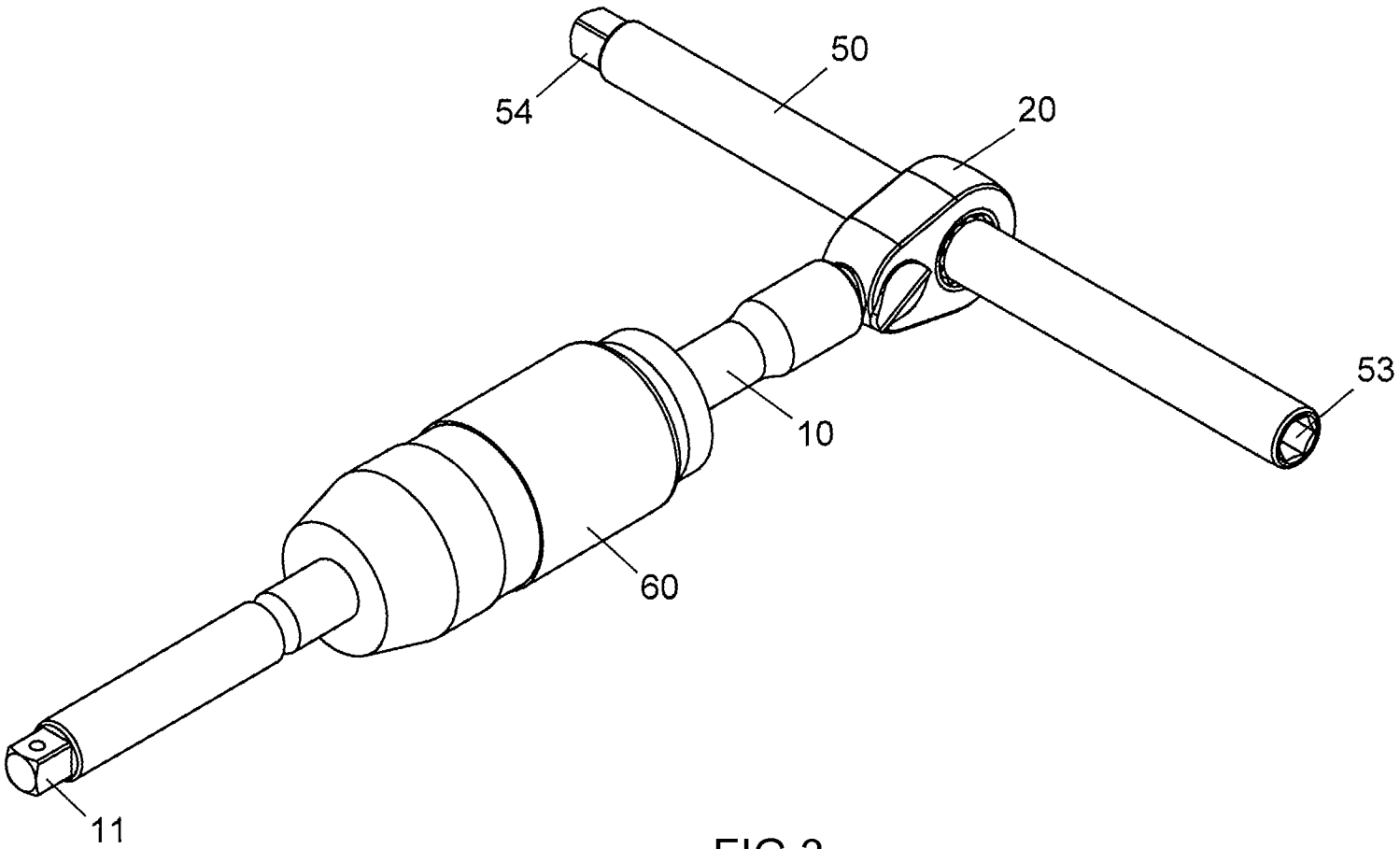
FIG. 3 is a perspective view to show the hand tool assembly of the present invention.

Referring to FIGS. 1 to 3, the hand tool assembly of the present invention comprises a cylindrical first body 10 having a first connection portion 11 on the first end thereof, and a second connection portion 13 on the second end thereof. Multiple first grooves 12 are defined in the outer periphery of the first body 10. The first connection portion 11 is a rectangular head, and the second connection portion 13 is a rectangular recess. A driving head 20 has a third connection portion 21 extending from one end thereof, and the third connection portion 21 is connected to the second connection portion 13 of the second end of the first body 10. The driving head 20 has a non-circular mounting hole 31. A ratchet mechanism is located in the driving head 20 and includes a ratchet wheel 30. An engaging slot 32 defined in the inner periphery of the mounting hole 31, multiple protrusions 310 extend from the inner periphery of the mounting hole 31, and multiple teeth 33 defined on the outer periphery of ratchet wheel 30. A positioning member 40 is engaged with the engaging slot 32.

A cylindrical second body 50 extends through the mounting hole 31. A sixth connection portion 53 and a seventh connection portion 54 are respectively formed on two ends of the second body 50. The sixth connection portion 53 is a hexagonal recess, and a seventh connection portion 54 is a rectangular head. A fifth connection portion 51 is formed on the outer periphery of the second body 50 and located at the middle portion of the second body 50. The fifth connection portion 51 is engaged with the mounting hole 31. The fifth connection portion 51 has a second groove 52 defined at its middle portion. The positioning member 40 is engaged with the engaging slot 32 and the second groove 52. Multiple engaging teeth 510 defined on outer periphery of the fifth connection portion 51 are provided for engaging with the recesses between the multiple protrusions 310.

A handle unit 60 has a handle 66, a control member 63 and two engaging members 67, wherein the engaging members 67 are two balls. The first body 10 extends through the handle 66. When the handle 66 moves to a first position relative to the first body 10, the control member 63 moves to a second position relative to the handle 66. The control member 63 pushes the engaging members 67 to be engaged with one of the first grooves 12 to position the handle 66 to the first body 10. The user holds the handle 66 to rotate the driving head 20, this is the first operation status.

Figure 4:
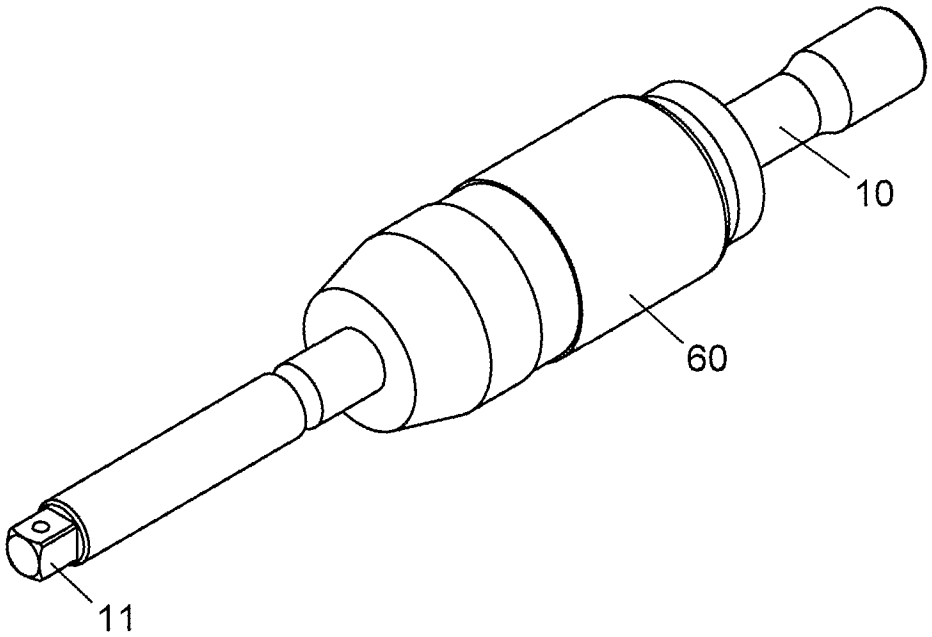
FIG. 4 shows the second operation status of the hand tool assembly of the present invention.

As shown in FIG. 4, the driving head 20 in FIG. 3 is removed from the first body 10, and the first body 10 is connected with the handle unit 60 which is positioned at any of the first grooves 12 so as to adjust the distance between the handle 66 and the driving head 20.

Figure 5:
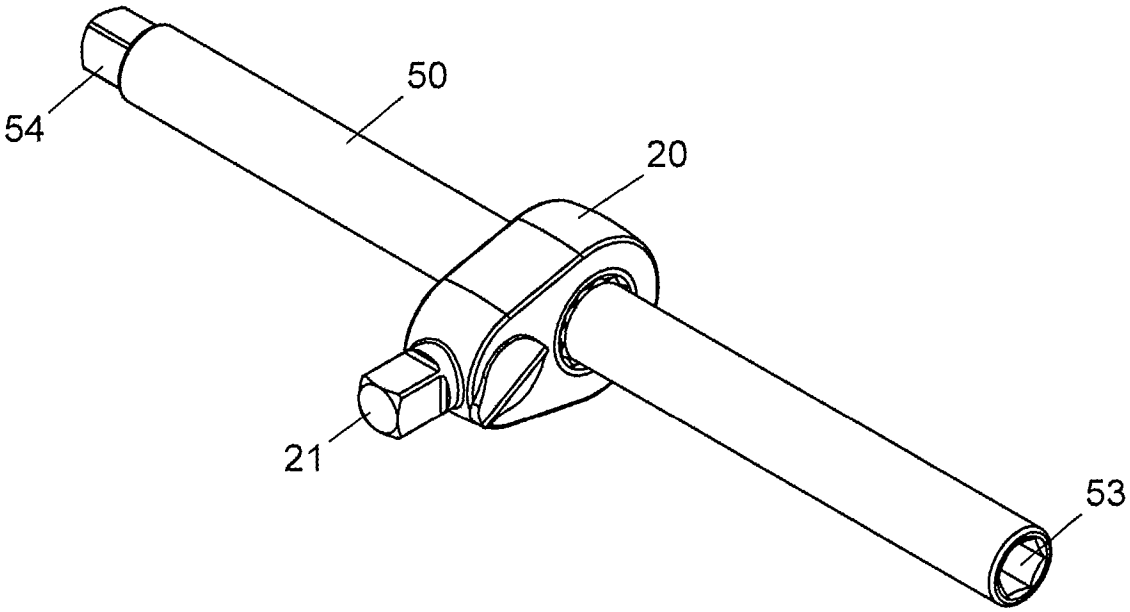
FIG. 5 shows the third operation status of the hand tool assembly of the present invention.

As shown in FIG. 5, the driving head 20, the ratchet wheel 50 and the second body 50 are assembled together. When the driving head 20 is rotated, the ratchet wheel 30 and the second body 50 are rotated in the same direction as the driving head 20, so that the hand tool that is connected to the sixth or seventh connection portion 53, 54 is rotated. Alternatively, when applying a force to the second body 50 and rotating the driving head 20, the hand tool that is connected to the third connection portion 21 is rotated.

Figure 6:
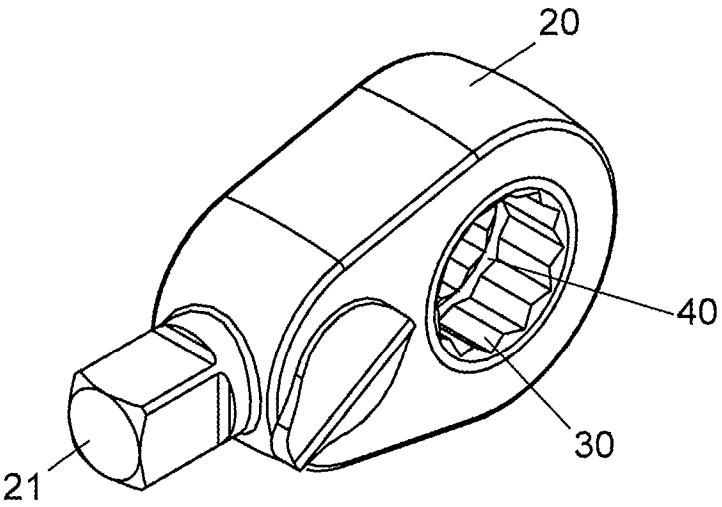
FIG. 6 shows the fourth operation status of the hand tool assembly of the present invention.

As shown in FIG. 6, the ratchet wheel 30 is rotatably located in the driving head 20 and the positioning member 40 is engaged with the engaging slot 32. The user holds the third connection portion 21 to use the present invention as a ratchet wrench. Alternatively, the user may rotate the driving head 20 to rotate a hand tool on the third connection portion 21.

Figure 7:
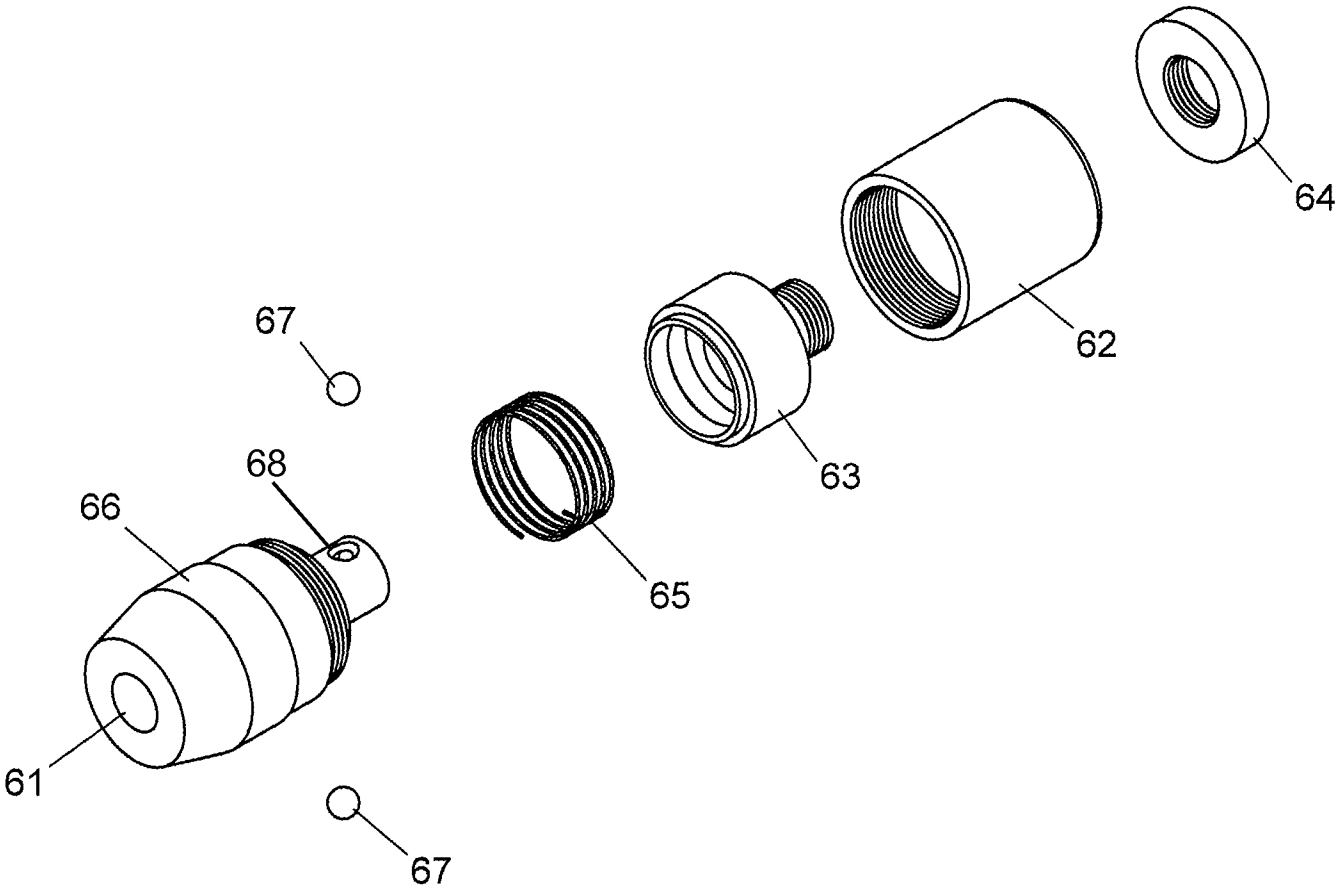
FIG. 7 is an exploded view of the handle unit of the hand tool assembly of the present invention.

As shown in FIG. 7, the handle unit 60 has a cylindrical sleeve 62, a ring 64 and a resilient member 65. There are two engaging members 67 which are two balls. The control member 63 is located in the sleeve 62 and has a protrusion from one end thereof. The protrusion of the control member 63 protrudes beyond the sleeve 62 and is threadedly connected to the ring 64. The ring 64 is located on an end of the sleeve 62. The resilient member 65 is located in the sleeve 62 and biases the control member 63 against an end of the sleeve 62 to be a third position. The handle 66 has a first end which is threadedly connected to the sleeve 62. The handle 66 has axial penetrating hole 61 for the first body 10 to pass through, and has two radial holes 68. The two engaging members 67 are received in the two radial holes 68 of the handle 66. When the control member 63 is moved relative to the handle 66 to the second position, and compresses the resilient member 65, the control member 63 is disengaged from the second groove 12.

Figure 8:
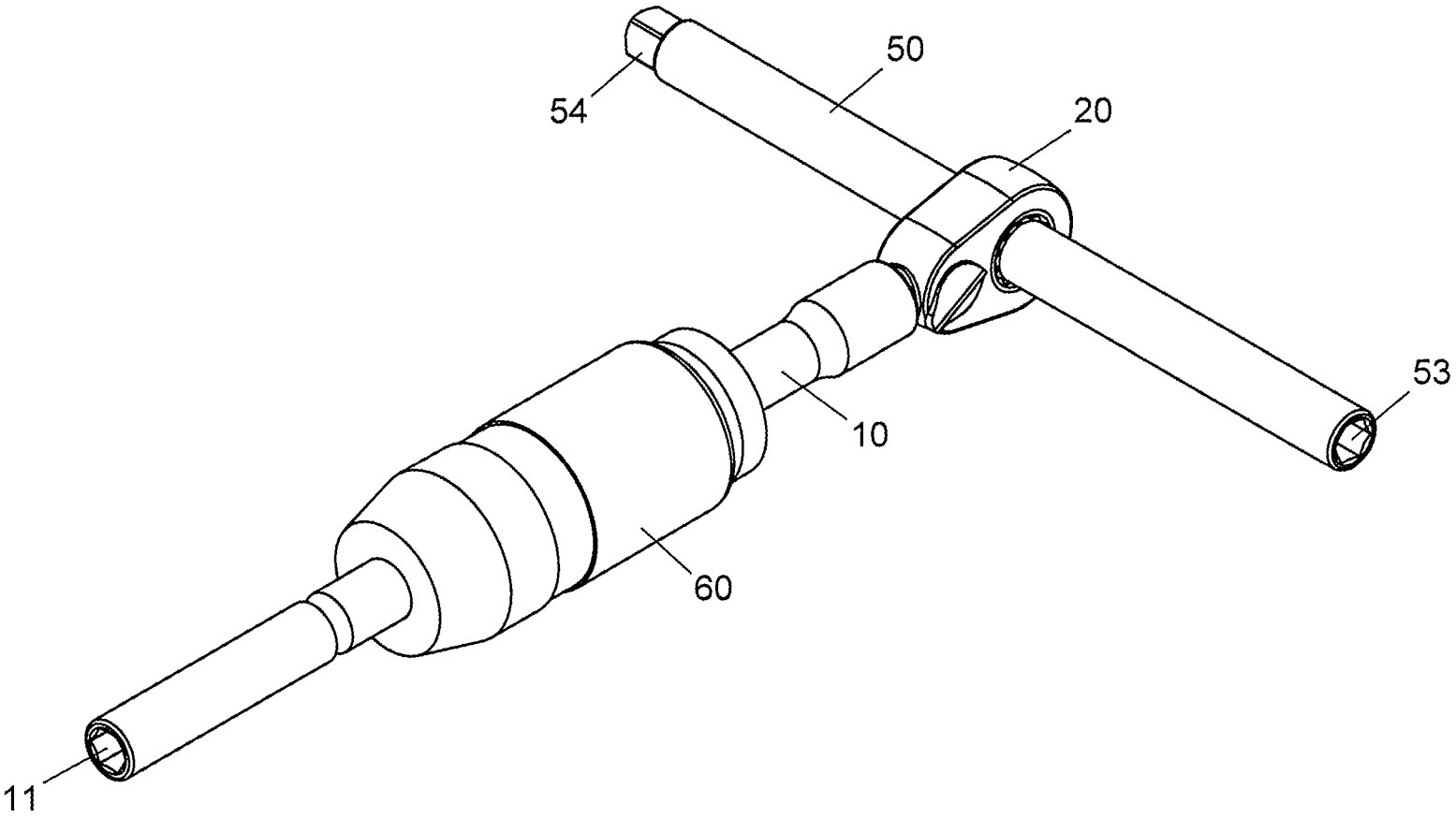
FIG. 8 is a perspective view to show the second embodiment of the hand tool assembly of the present invention.
Figure 9:
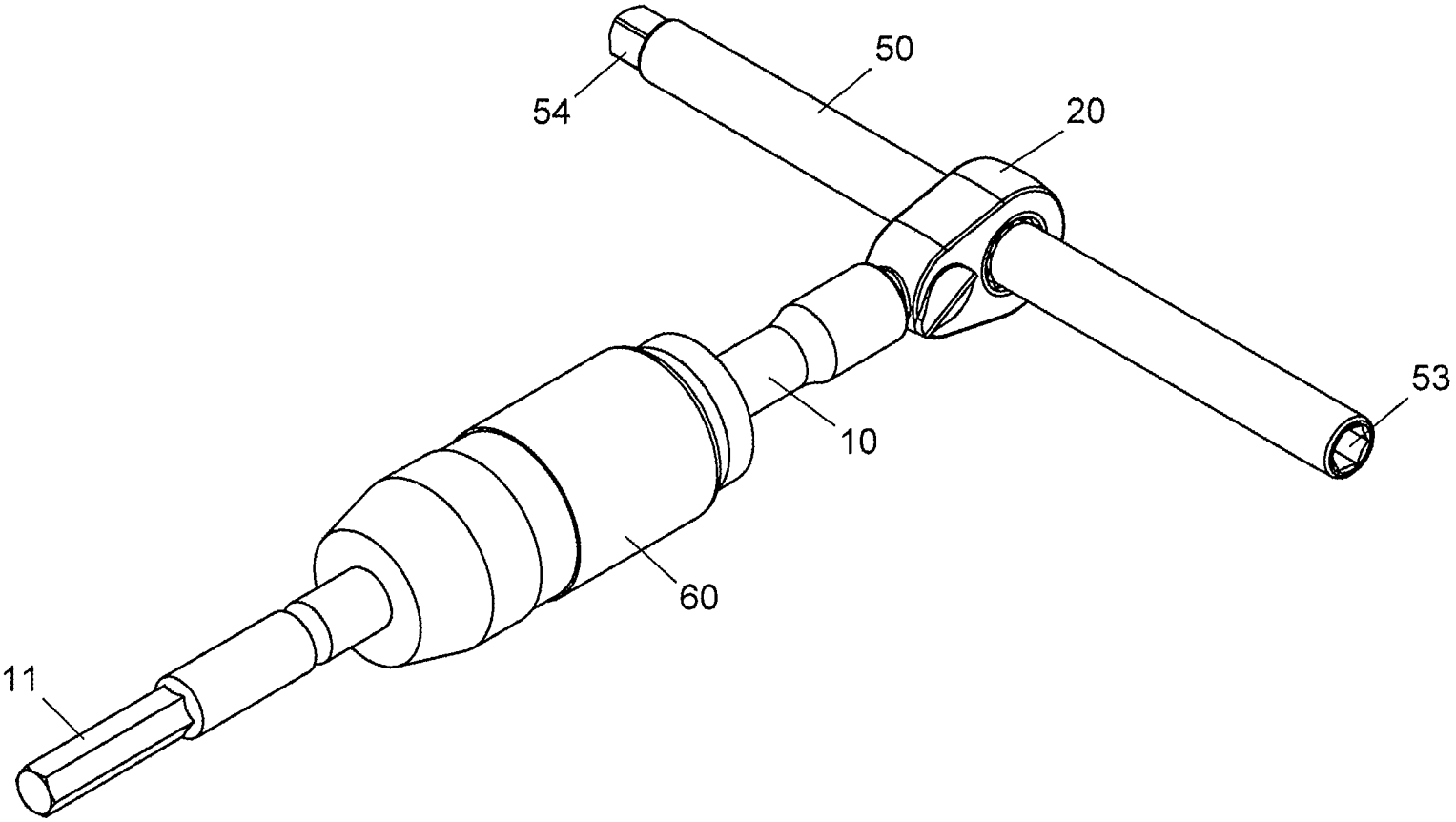
FIG. 9 is a perspective view to show the third embodiment of the hand tool assembly of the present invention.
Figure 10:
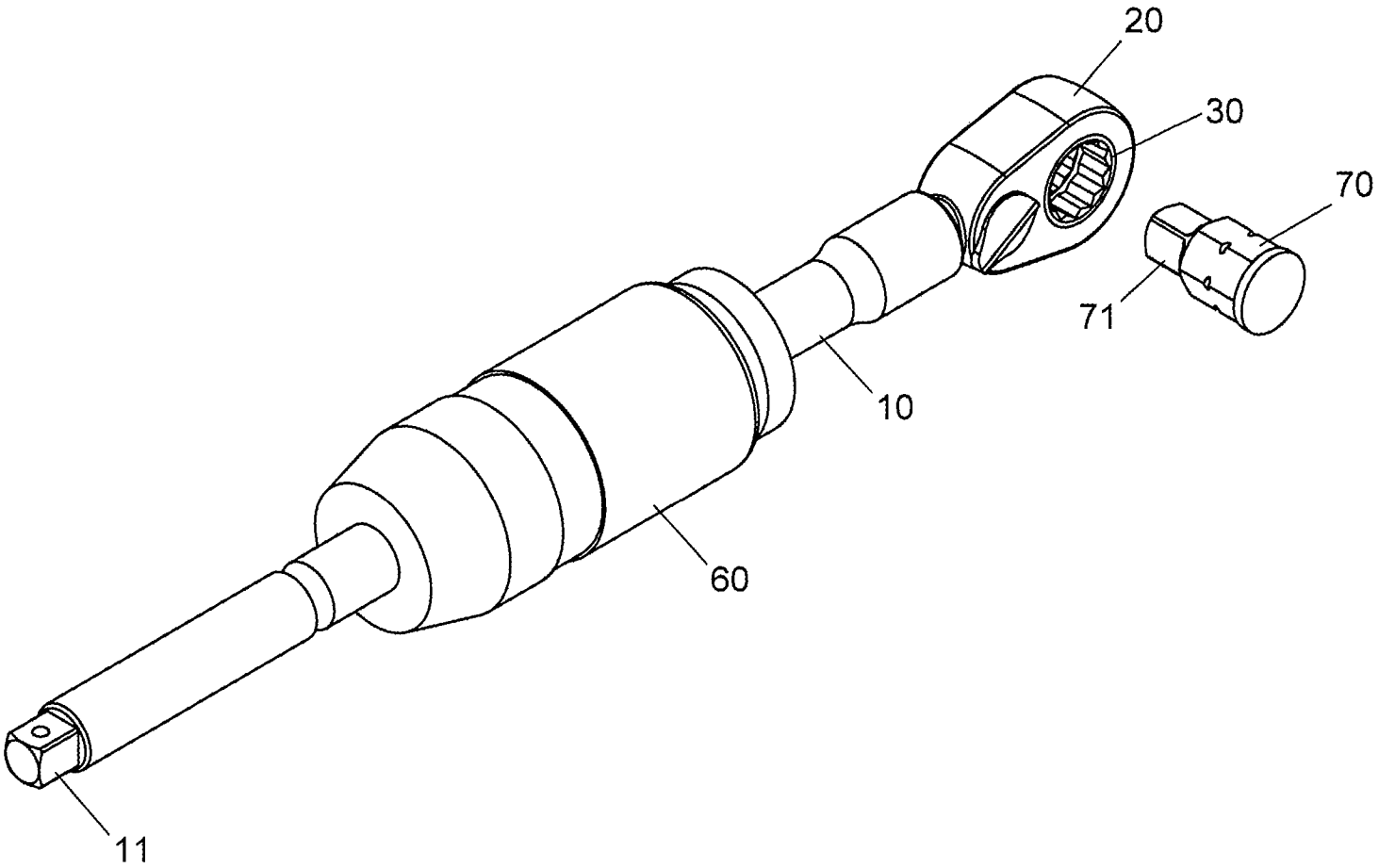
FIG. 10 is a perspective view to show the fourth embodiment of the hand tool assembly of the present invention.

As shown in FIG. 8, the first connection portion 11 is a hexagonal recess to receive a bit therein. FIG. 9 shows that the first connection portion 11 is a hexagonal head. As shown in FIG. 10, a third body 70 has an eighth connection portion 71 which is a rectangular head. The eighth connection portion 71 is engaged with the mounting hole 31. The eighth connection portion 71 can be connected with a socket, a connection rod, a universe connector or a screw driving with a socket. The third body 70 is used to rotate another hand tool.

Figure 11:
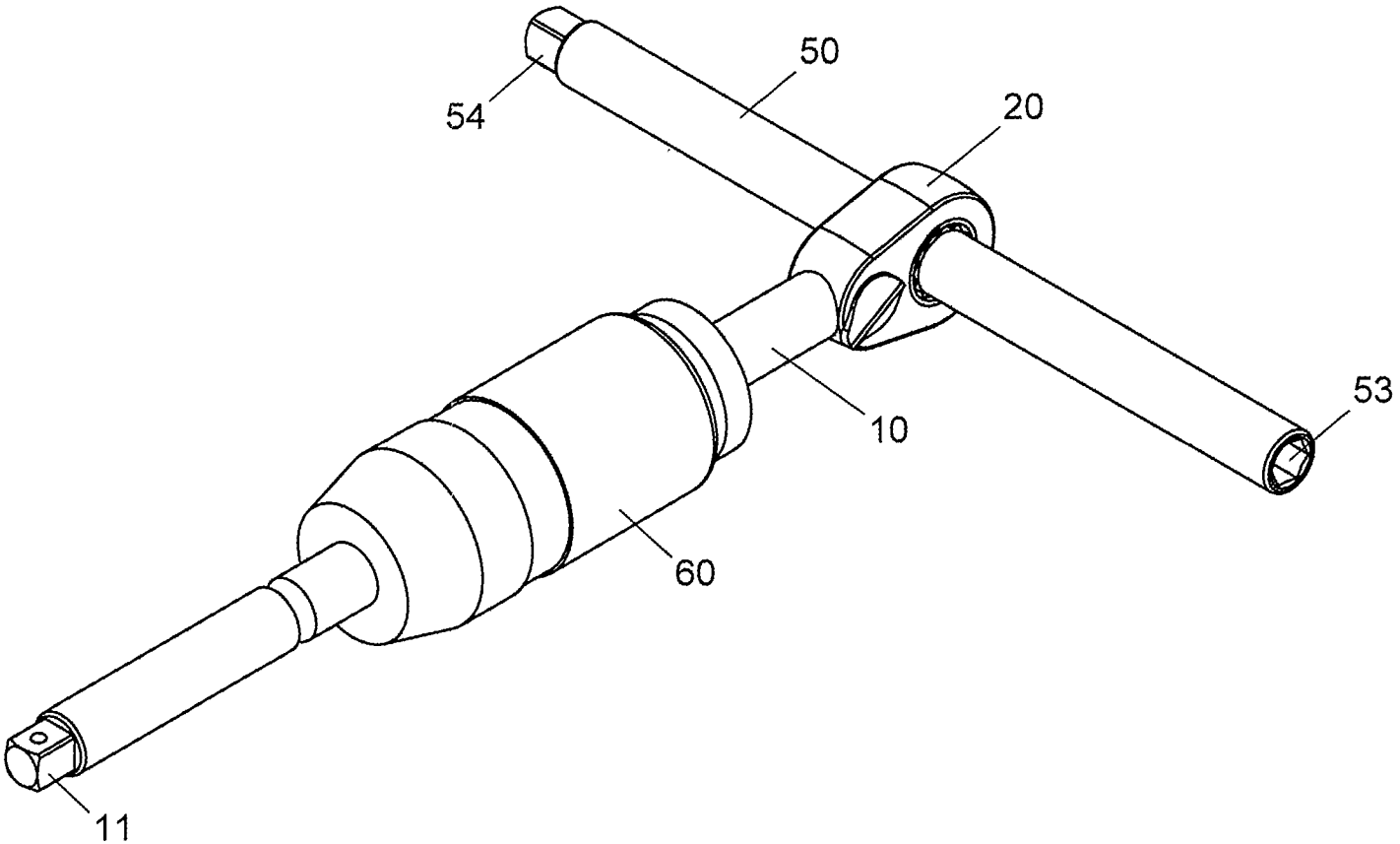
FIG. 11 is a perspective view to show the fifth embodiment of the hand tool assembly of the present invention.
Figure 12:
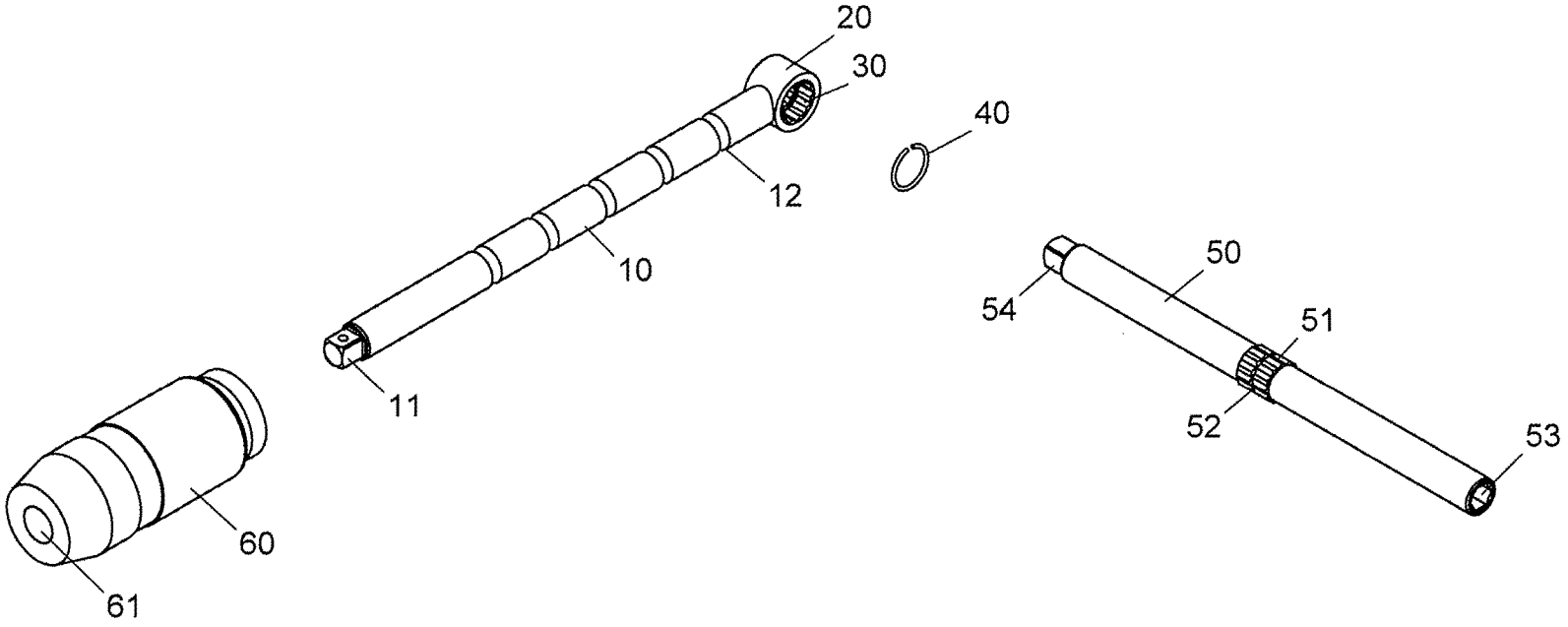
FIG. 12 is a perspective view to show the sixth embodiment of the hand tool assembly of the present invention.
Figure 13:
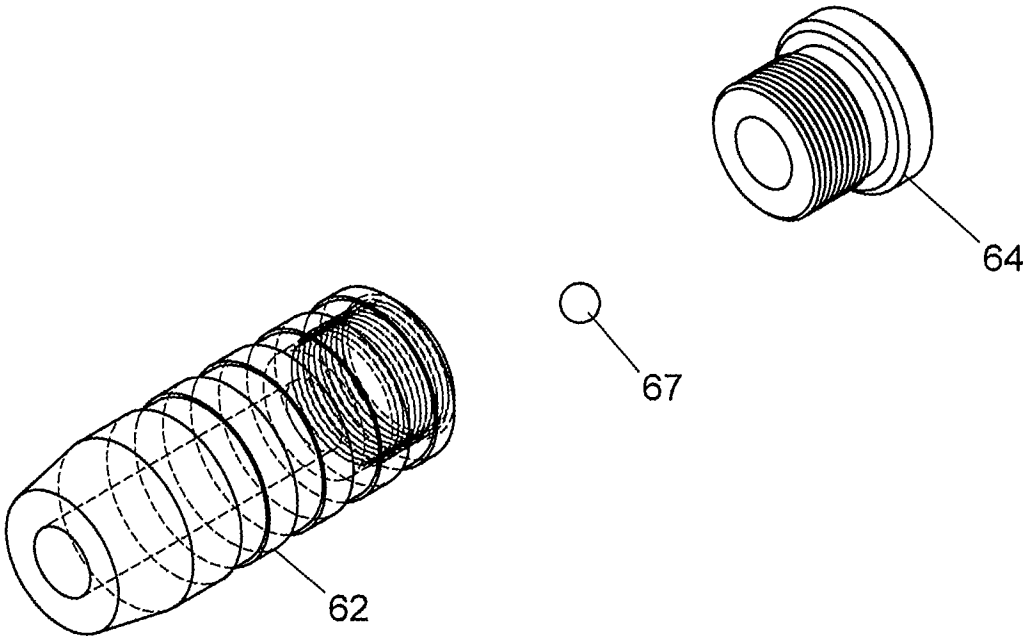
FIG. 13 is a perspective view to show the seventh embodiment of the hand tool assembly of the present invention.

FIG. 11 shows that the first body 10 and the driving head 20 are integral as a one-piece. FIG. 12 shows that the first body 10, the driving head 20 and the protrusions 310 are integral as a one-piece. FIG. 13 shows that the handle unit 60 includes a sleeve 62, a ring 64 and an engaging member 67.

The advantages of the present invention are as follows:

The second body 50 can be removed from the ratchet wheel 30 and put parallel to the first body 10 so as to reduce the storage space.

The second body 50 can be removed from the ratchet wheel 30, and the first body 10, the driving head 20, the ratchet wheel 30 and the handle unit 60 are connected to be a ratchet wrench. The handle unit 60 is used as a handle, and performs as a T-bar and a ratchet wrench.

The first body 10, the driving head 20 and the second body 50 are able to be connected to each other, or to be detached from each other to obtain at least four operation functions.

The first, third, sixth and seventh connection portions 11, 21, 53, 54 can be connected to different hand tools.

The driving head 20 controls the ratchet wheel 30 to rotate in one or two directions. The second body 50 extends through the mounting hole 31 and can rotate the driving head 20.

The positioning member 40 is engaged with the engaging slot 32 and the second groove 52 to secure the second body 50 in the mounting hole 31.

As shown in FIG. 4, the combination of the first body 10 and the handle unit 60 can be used as a hand tool to quickly rotate an object. The first connection portion 11 is a rectangular head which is connected to a rectangular recess.

As shown in FIG. 5, when the driving head 20 is rotated, the second body 50 and the ratchet wheel 30 are rotated, the hand tools on the sixth and seventh connection portions 53, 54 are rotated.

As shown in FIG. 6, the ratchet wheel 30 is received in the driving head 20, the positioning member 40 is engaged with the engaging slot 32, the user holds the third connection portion 21 to use as a ratchet wrench.

While we have shown and described the embodiment in accordance with the present invention, it should be clear to those skilled in the art that further embodiments may be made without departing from the scope of the present invention.

What is claimed is:

1. A hand tool assembly comprising:

a cylindrical first body having a first connection portion on a first end thereof, multiple first grooves defined in an outer periphery of the first body;

a driving head connected to a second end of the first body and having a non-circular mounting hole, an engaging slot defined in an inner periphery of the mounting hole, a positioning member engaged with the engaging slot;

a cylindrical second body extending through the mounting hole, a sixth connection portion and a seventh connection portion respectively formed on two ends of the second body, a fifth connection portion formed on an outer periphery of the second body and located at a middle portion of the second body, the fifth connection portion engaged with the mounting hole, the fifth connection portion having a second groove, the positioning member engaged with the engaging slot and the second groove, and a handle unit having a handle, a control member and at least one engaging member, the first body extending through a axial penetrating hole of the handle, wherein when the handle moves to a first position relative to the first body, the control member moves to a second position relative to the handle, the control member pushes the at least one engaging member to be engaged with one of the first grooves to position the handle to the first body.

2. The hand tool assembly as claimed in claim 1, wherein the engaging slot receives a bead and a spring therein, the bead is biased by the spring to partially be engaged with the second groove.

3. The hand tool assembly as claimed in claim 1, wherein the first connection portion is one of a rectangular head, a hexagonal recess and a hexagonal head.

4. The hand tool assembly as claimed in claim 1, wherein the sixth connection portion is a hexagonal recess, the seventh connection portion is a rectangular head.

5. The hand tool assembly as claimed in claim 1, wherein the handle unit has a cylindrical sleeve, a ring and a resilient member, there are two engaging members which are two balls, the control member is located in the sleeve and has a protrusion from one end thereof, the protrusion of the control member protrudes beyond the sleeve and is threadedly connected to the ring, the ring is located on an end of the sleeve, the resilient member is located in the sleeve and biases the control member against an end of the sleeve to be a third position, the handle has a first end which is threadedly connected to the sleeve, the handle has two holes and the two engaging members are received in the two holes of the handle, when the control member is moved relative to the handle to the second position, and compresses the resilient member, the control member is disengaged from the second groove.

6. The hand tool assembly as claimed in claim 1 further comprising a third body having an eighth connection portion which is a rectangular head, the eighth connection portion engaged with the mounting hole.

7. The hand tool assembly as claimed in claim 1, wherein the first body has a second connection portion on a second end thereof, the driving head has a third connection portion which is connected to the second connection portion.

8. The hand tool assembly as claimed in claim 1, wherein the driving head has a ratchet mechanism therein which controls a ratchet wheel to rotate in a desired direction, the mounting hole is defined through the ratchet wheel.

9. The hand tool assembly as claimed in claim 1, wherein the mounting hole has multiple protrusions extending from the inner periphery thereof, the fifth connection portion has multiple teeth which are engaged with recesses between the protrusions.

10. The hand tool assembly as claimed in claim 1, wherein the fifth connection portion is a rod with six sides.

* * * * *